United States Patent [19]

Stiegler

[11] Patent Number: 4,512,327

[45] Date of Patent: Apr. 23, 1985

[54] MUFFLE OVEN FOR HEATING FOODSTUFFS

[75] Inventor: Hartmut Stiegler, Herborn, Fed. Rep. of Germany

[73] Assignee: Buderus Aktiengesellschaft, Wetzlar, Fed. Rep. of Germany

[21] Appl. No.: 583,932

[22] Filed: Feb. 27, 1984

[30] Foreign Application Priority Data

Feb. 28, 1983 [DE] Fed. Rep. of Germany ..... 3306972

[51] Int. Cl.[3] ..... F24C 15/32

[52] U.S. Cl. ..... 126/21 A; 126/273 R; 219/400

[58] Field of Search ..... 126/21 A, 21 R, 19 R, 126/39 C, 273 R; 219/400, 385, 386; 99/447, 355

[56] References Cited

U.S. PATENT DOCUMENTS 3,719,180 3/1973 Pere ..... 126/21 A

FOREIGN PATENT DOCUMENTS

EP94816 11/1983 European Pat. Off. ..... 126/21 A
2339448 2/1975 Fed. Rep. of Germany ... 126/21 A
2557867 6/1977 Fed. Rep. of Germany ... 126/21 A
631323 11/1949 United Kingdom .
2109920A 6/1983 United Kingdom .

*Primary Examiner*—James C. Yeung
*Attorney, Agent, or Firm*—Karl F. Ross; Herbert Dubno

[57] ABSTRACT

A muffle oven for the heating of foodstuffs has a closed housing with a treatment chamber separated by a perforated partition from an air-circulating compartment which forms rear and lateral air spaces surrounding that chamber on three sides. A radial blower, driven by an external motor located at an intermediate level in the rear air space, is bracketed by an upper and a lower baffle each having two aerodynamic deflecting surfaces converging at a flow-dividing edge which cause the air discharged by the blower to spread symmetrically into the lateral air spaces after passing two sets of heating elements. The flow-dividing edges of the two baffles are relatively offset and lie on opposite sides of a vertical axial plane of the rotor so as to point toward the rotor at locations where the flow of the discharged air is essentially vertical. The heated air, after entering the treatment chamber from the sides, is returned to an axial intake of the blower.

3 Claims, 3 Drawing Figures

MUFFLE OVEN FOR HEATING FOODSTUFFS

FIELD OF THE INVENTION

My present invention relates to an apparatus for heating foodstuffs with the aid of a circulating flow of hot air.

BACKGROUND OF THE INVENTION

An apparatus of this type, designed as a muffle oven, is the subject matter of commonly owned U.S. Pat. No. 3,978,843 in the name of Wilfried Durth. As shown there, the oven has a generally closed housing of prismatic shape with rectangular horizontal and vertical cross-section. The interior of that housing is divided by a partition into a central treatment chamber and an air-circulating compartment which surrounds that chamber on three sides by forming a rear air space that opens into two lateral air spaces. A rotary blower disposed at an intermediate level in the rear air space has an intake end centered on a horizontal axis and aligned with an opening in a rear section of the partition through which air from the treatment chamber can be aspirated by the blower which is driven by an external motor. The aspirated air is expelled by the blower into the rear space of the circulating compartment from which it returns to the treatment chamber by way of the lateral air spaces and side apertures in the partition. Heating elements disposed in the circulation compartment at corners forming junctions between the rear and lateral air spaces maintain the flow at an elevated temperature designed for cooking foods resting on a rack in the treatment chamber.

The apparatus of the prior patent operates in a generally satisfactory manner but does not fully utilize the thermal energy generated by the heating elements since the air flowing past them is not uniformly distributed over their lengths. Losses of energy also occur at adjustable vanes designed to control the rate of air circulation; these losses are intensified by turbulence at other locations where the flow changes direction, as at the aforementioned junctions between the rear and lateral air spaces.

The nonuniformity of contact between the heating elements and the surrounding air flow is at least partly due to the fact that a radial blower, with a set of equispaced peripheral blades, generally emits an air stream that is not radially oriented with reference to the blower axis. Thus, the blades impart to the air stream a tangenal velocity component whose direction and magnitude are determined by the sense and the speed of rotation. This means that the air flow will be unsymmetrically divided on striking the top and the bottom of the housing; it will therefore have a greater density in the lower half of the rear air space on one side of the blower and in its upper half on the other side thereof.

OBJECT OF THE INVENTION

Thus, the object of my present invention is to provide an improved food-heating oven of the type described in which these drawbacks, namely turbulence and nonuniformity of the air flow, are largely eliminated.

SUMMARY OF THE INVENTION

I have found, in accordance with my present invention, that the air discharged by a radial blower in a rear air space of a circulation compartment of an internally subdivided housing of the character referred to can be substantially evenly split into two lateral air streams with the aid of stationary upper and lower baffle means respectively disposed in that space above and below the blower, with the upper baffle means forming a pair of downwardly concave aerodynamic deflecting surfaces which converge at an upper flow-dividing edge pointed toward the blower and with the lower baffle means forming a pair of upwardly concave aerodynamic deflecting surfaces converging at a lower flow-dividing edge also pointed toward the blower. The upper and lower baffle means should extend across the width of the rear air space so as to intercept the entire ascending and descending flows.

The aerodynamic shape of these deflecting surfaces contributes significantly to the desired elimination of turbulence along the path of the circulating hot air. A further improvement in this respect can be achieved by rounding the inner wall surface of the housing at the junctions between the rear and lateral air spaces.

Advantageously, pursuant to a further feature of my invention, each pair of deflecting surfaces is of generally cycloidal configuration leveling off toward the upper and lower corners of the rear air space. In any event, the surfaces of the two pairs are to be nearly tangent at the respective flow-dividing edges to two mutually parallel planes which substantially coincide with the direction of flow at points of the blower periphery confronted by those edges. With a given sense of blower rotation and at a certain speed, there will be two positions at opposite sides of a vertical axial plane of the blower where the flow direction is essentially vertical. Thus, I prefer to dispose the flow-dividing edges of the baffles in line with these relatively offset positions.

BRIEF DESCRIPTION OF THE DRAWING

The above and other features of my invention will now be described in detail with reference to the accompanying drawing in which.

SPECIFIC DESCRIPTION

Figure 1:
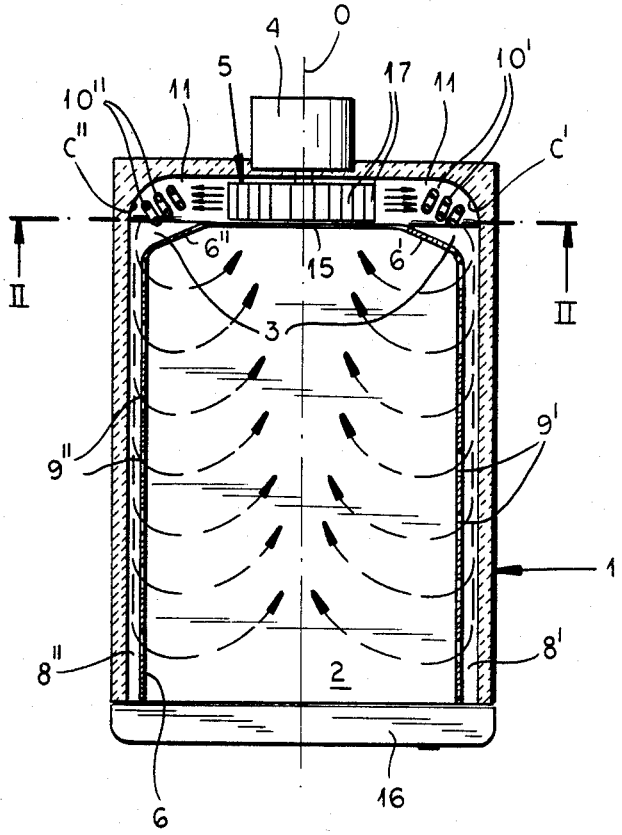
FIG. 1 is a cross-sectional top view of an oven embodying my present invention, take on the line I—I of FIG. 2.

As shown in the drawing, a muffle oven generally similar to that disclosed in the aforementioned Durth patent comprises a prismatic housing 1 of rectangular horizontal as well as vertical cross-section whose interior forms a treatment chamber 2 for food to be cooked. The treatment chamber may be provided with an extractable rack, such as the one shown in the prior patent, designed to support the foodstuffs to be heat-treated. The rack can be introduced and removed through a front entrance which during operation is closed by a door 16.

Figure 2:
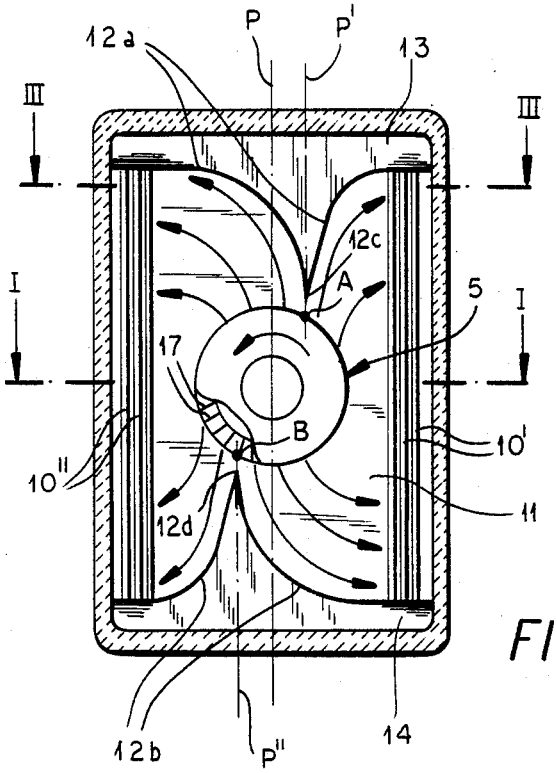
FIG. 2 is a longitudinal sectional view taken on the line II—II of FIG. 1.

A sheet-metal partition 6, which may be fixedly positioned but can also be insertable and removable together with the aforementioned rack, separates the treatment chamber 2 from an air-circulation compartment surrounding it on three sides, this compartment being divided into two lateral air spaces 8', 8'' and a rear air space 11 communicating freely with one another. Air spaces 8' and 8'' are connected with chamber 2 through side apertures 9' and 9'' in the lateral sections of partition 6 whose transverse rear section has a central opening 15 in line with an intake end of a radial blower 5 disposed in the rear air space 11. Blower 5, driven by an external electric motor 4, has a horizontal axis 0 which preferably lies at the midpoint of the rear housing wall and on which the opening 15 is centered. An array of peripheral blades 17 of rotor 5 generates an exiting air stream with both a radial and a tangential velocity component. With counterclockwise rotation, as indicated by an arrow in FIG. 2, the flow will ascend and descend vertically at two horizontally offset points A and B lying on opposite sides of a vertical plane P which includes the blower axis 0.

In accordance with an important feature of my present invention, an upper and a lower region of rear space 11 are partly occupied by respective baffles 13 and 14 which extend across the full width of that space and form respective pairs of generally cycloidal aerodynamic deflecting surfaces 12*a* and 12*b*. Surfaces 12*a* are downwardly concave and converge at a peak 12*c* where they are nearly tangent to a vertical plane P' passing through point A. In an analogous manner, surfaces 12*b* are upwardly concave and converge at a peak 12*d* where they are nearly tangent to a vertical plane P'' passing through the point B. Peaks 12*c* and 12*d* thus act as flow-dividing edges which respectively split the ascending and the descending air flow into components of substantially equal magnitude and uniform density passing into the lateral compartments 8' and 8''. The two air streams thus generated pass by respective sets of heating elements in the form of upright rods 10', 10'' extending over the entire effective height of air space 11 as bounded at the top and at the bottom by the deflecting surfaces 12*a* and 12*b*. The air discharged by blower 5 is maintained thereby at the desired food-treating temperature as it is continuously recirculated from space 11 through spaces 8' and 8'' into chamber 2 and returned to the blower via opening 15. The side apertures 9' and 9'', which may be round holes or slots, are advantageously distributed in a manner taking the progressively decreasing density of the two air streams into account—as by becoming more closely spaced or collectively wider toward the entrance door 16—in order to insure a substantially uniform heating effect throughout chamber 2.

Figure 3:
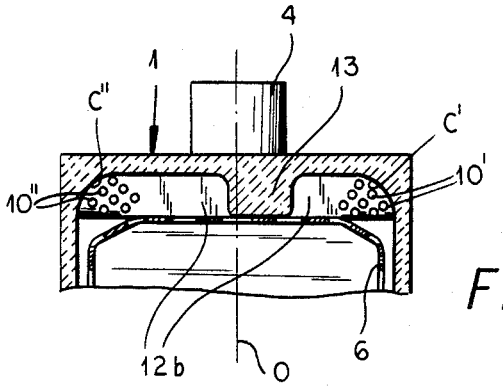
FIG. 3 is a fragmentary sectional view taken on the line III—III of FIG. 2.

From FIGS. 1 and 3 it will be noted that an inner wall surface of housing 1 has quarter-cylindrical portions C', C'', with a large radius of curvature, at the junctions between its rear wall and its sidewalls, to provide a smooth transition between air spaces 11 and 8', 8''. The aerodynamically shaped deflecting surfaces 12*a* and 12*b*, which level off at the upper and lower corners of space 11, advantageously are rounded off at locations where the rear section of partition 6 deviates from them as indicated at 6' and 6''. This will reduce the formation of eddies in the region where space 11 merges into spaces 8' and 8''.

As particularly illustrated in FIG. 3 for the upper baffle 13, both baffles may be designed as integral forward extensions of the rear housing wall and thus made of the same thermally insulating material. It is, however, also possible to make these baffles part of a sheet-metal structure integral with partition 6 and, possibly, with a food-supporting rack to be inserted into and removed from the interior of the housing as mentioned above. With such an aerodynamic structure I may therefore improve the heating efficiency of a conventional muffle oven such as that shown in the Durth patent.

If necessary, the oven according to my present invention may also be provided with adjustable vanes for controlling the air-circulation rates in accordance with the teachings of that prior patent. Even without such vanes, the oven temperature can be controlled by varying the energization of heating rods 10', 10'' and/or by adjusting the blower speed within a range in which the distance of the vertical-emission points to A and B from central plane P does not change significantly. The locations of these points may be suitably preselected by the setting of blades 17 which generally will be skew to the blower axis 0.

I claim:

1. An apparatus for heating foodstuffs, comprising:

a generally closed housing;

partition means dividing the interior of said housing into a treatment chamber and an air-circulating compartment surrounding said chamber on three sides, said compartment forming a rear air space and two lateral air spaces merging into one another, said partition means having side apertures connecting said lateral air spaces with said chamber and a central opening connecting said chamber with said rear air space;

a radial blower in said rear air space centered on a horizontal axis and driven by an external motor, said blower having an axial intake end aligned with said central opening and having peripheral blades for discharging air in generally radial directions into said rear air space;

stationary upper baffle means above said blower extending across the width of said rear air space and forming a pair of downwardly concave aerodynamic deflecting surfaces converging at an upper flow-dividing edge pointed toward said blower for substantially evenly splitting an ascending air flow between said lateral air spaces;

stationary lower baffle means below said blower extending across the width of said rear air space and forming a pair of upwardly concave aerodynamic deflecting surfaces converging at a lower flow-dividing edge pointed toward said blower for substantially evenly splitting a descending air flow between said lateral air spaces; and heating means disposed in said compartment in the paths of air streams directed by said blower together with said upper and lower baffle means into said lateral air spaces for circulation through said chamber by way of said apertures and said central opening, said deflecting surfaces being nearly tangent at said flow-dividing edges to two mutually parallel planes substantially coinciding with the flow direction of air leaving said blower at peripheral locations respectively confronted by said flow-dividing edges, said mutually parallel planes being vertical and lying on opposite sides of a vertical plane of symmetry of said housing including the axis of said blower, said mutually parallel planes having a spacing less than the diameter of said blower and a spacing each from said plane of symmetry less than the radius of said blower, said pairs of deflecting surfaces being of generally cycloidal configuration leveling off toward upper and lower corners of said rear air space, said upper and lower baffle means being integral forward extensions of a rear wall of said housing, said housing being of generally rectangular horizontal cross-section with rounded inner wall surfaces at junctions of said rear wall with respective sidewalls.

2. An apparatus as defined in claim 1 wherein said heating means comprises two sets of upright heating rods in the vicinity of said junctions.

3. An apparatus as defined in claim 2 wherein said heating rods extend over the full height of said rear space between said upper and lower baffle means.

* * * * *